US005588885A

United States Patent [19]

Götz et al.

[11] Patent Number: 5,588,885

[45] Date of Patent: Dec. 31, 1996

[54] CONNECTOR WITH TERMINALS HAVING ANTI-WICKING GEL

[75] Inventors: Klaus P. Götz, Lorsch; Manfred Schaarschmidt, Bensheim; Günter Feldmeier, Lorsch, all of Germany

[73] Assignee: The Whitaker Corporation, Wilmington, Del.

[21] Appl. No.: 362,312

[22] Filed: Dec. 22, 1994

[30] Foreign Application Priority Data

Feb. 1, 1994 [GB] United Kingdom ..... 9401918

[51] Int. Cl.[6] ..... H01R 4/20; H01R 9/09

[52] U.S. Cl. ..... 439/876; 439/83; 228/39

[58] Field of Search ..... 439/936, 876, 439/83; 228/39

[56] References Cited

U.S. PATENT DOCUMENTS

| | | | |
|---|---|---|---|
| 2,669,702 | 2/1954 | Klostermann | 339/196 |
| 3,864,004 | 2/1975 | Friend | 439/876 |
| 3,877,769 | 4/1975 | Berg et al. | 439/83 |
| 3,989,331 | 11/1976 | Hanlon | 439/876 |
| 4,584,433 | 4/1986 | Bowsky et al. | 174/152 |
| 4,729,739 | 3/1988 | Coffee et al. | 439/71 |
| 4,976,634 | 12/1990 | Green et al. | 439/589 |
| 5,032,085 | 7/1991 | Alwine et al. | 439/79 |
| 5,044,992 | 9/1991 | Dzwonczyk et al. | 439/608 |
| 5,090,919 | 2/1992 | Tsuji | 439/519 |
| 5,453,017 | 9/1995 | Belopolsky | 439/83 |

FOREIGN PATENT DOCUMENTS

| | | | |
|---|---|---|---|
| 2-52489 | 2/1990 | Japan | 439/876 |

*Primary Examiner*—P. Austin Bradley
*Assistant Examiner*—Jeffrey T. Knapp

[57] ABSTRACT

An electrical connector comprises a housing and terminals mounted therein, the terminals comprising contact tails for soldered connection to a printed circuit board. The contact tails have sealing material deposited thereon for sealing between the contact tail and housing to prevent solder and flux wicking onto contact sections of the terminals. The concept also advantageously provides sealing of the connector from the environment, whilst using minimal quantities of sealing material and having very small sealing surfaces for increased reliability thereof.

6 Claims, 1 Drawing Sheet

CONNECTOR WITH TERMINALS HAVING ANTI-WICKING GEL

BACKGROUND OF THE INVENTION

1. Field of the Invention

This invention relates to an electrical connector having terminals for soldered connection to a printed circuit board, whereby the terminals have a sealing material deposited thereon for preventing solder and flux wicking into contact portions of the terminal.

2. Description of the Prior Art

Solder wicking is a well known problem in the electrical industry, whereby during the soldering process of electrical contacts to printed circuit boards, the molten solder and flux flows up contact tails of the terminals due to the surface tension (i.e. capillary effect).

A number of solutions have been found to address this problem, for example as shown in U.S. Pat. No. 3,989,331 whereby the contact tail has a kink, or has a material deposited therearound to repel the solder and flux. Unfortunately for some applications, for example if the terminals are to be mounted in a connector, it may not be appropriate to have a kink therein, because the connector housing cavity must be made larger for passage of the kink which also makes sealing of the connector more difficult. The latter also increases the inaccuracy of alignment of the terminal with respect to the PCB. Application of the solder repellent is an expensive process and does not guarantee that solder doesn't flow therepast in all circumstances. Another example is shown in U.S. Pat. No. 4,976,634, whereby a sealing material is placed around contact tails of terminals proximate a mounting face of the connector. This is however a relatively expensive procedure as the sealing material must be applied to the assembled connector from the mounting face, whereby measures must be taken to prevent the sealing material from flowing into the contact area of the connector whilst nevertheless filling all the gaps between the terminal and connector housing. The latter reference has the advantage over the former reference in that the sealing material not only prevents wicking of the solder, but also seals the connector from the environment.

It would be desirable, to provide an electrical connector for soldered connection to a printed circuit board, that is sealed and overcomes the above mentioned problems.

SUMMARY OF THE INVENTION

It is therefore an object of this invention to provide an electrical connector with terminals for soldered connection that avoid wicking of solder and flux into contact portions of the terminals.

It is a further object of this invention to provide a reliable and cost-effective sealed connector.

The objects of this invention have been achieved by providing an electrical connector comprising an insulative housing with terminal receiving cavities extending therethrough, and electrical terminals having contact tails and being mountable in the terminal receiving cavities of the housing such that the contact tails project below a mounting face of the housing, whereby the contact tails have sealing material deposited thereon prior to mounting in the terminal receiving cavities. The concept can be advantageously used not only for connectors mounted to printed circuit boards for soldered connection, but also simply for sealed connectors whereby the sealing material could be hardenable, for example by a thermal or process once assembled to the connector housing.

DETAILED DESCRIPTION OF THE PREFERRED EMBODIMENT

Figure 3:
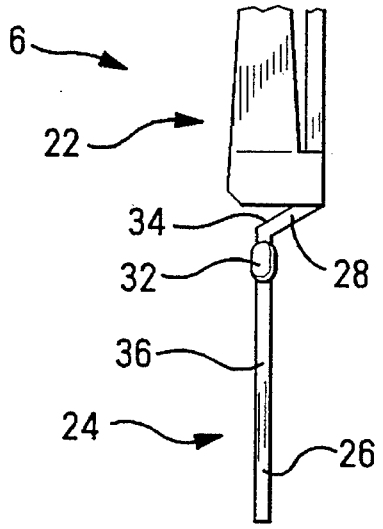
FIG. 3 is a side view of an electrical terminal of the connector shown in FIGS. 1 and 2.
Figure 2:
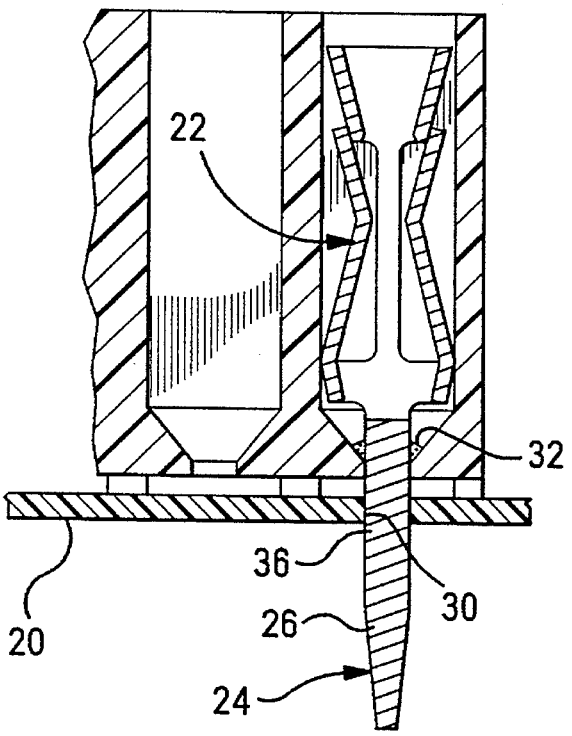
FIG. 2 is a cross-sectional view through lines 2—2 of FIG. 1.
Figure 1:
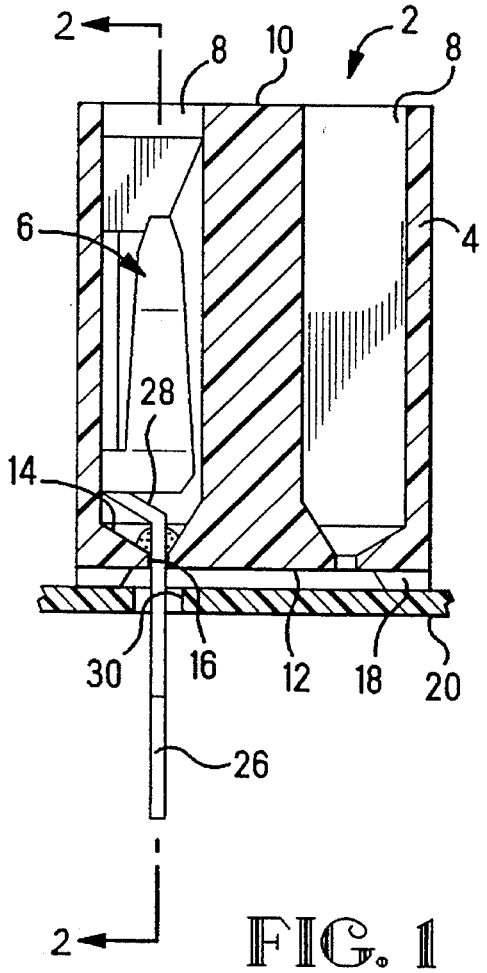
FIG. 1 is a cross-sectional view of an electrical connector.

With reference to FIGS. 1–3, an electrical connector 2 is shown comprising a housing 4 and terminals 6 mounted therein, the housing having terminal receiving cavities 8 extending therethrough from a terminal receiving face 10 to a printed circuit board mounting face 12, the cavities 8 comprising a funnel-shaped transition section 14 extending into a contact tail receiving cavity section 16 adjacent the mounting face 12. The insulative housing 4 further comprises spacers 18 extending below the mounting face 12 and mountable against a printed circuit board 20.

The terminal 6, comprises a contact section 22 for receiving a complementary contact pluggable thereinto, and a conductor contact section 24 comprising a contact tail 26 attached to the contact section 22 via a transition section 28, the contact tail 26 mountable through a hole 30 of the printed circuit board 20 and solderable thereto for electrical connection therewith. The terminal 6 further comprises sealing material 32 deposited on the contact tail 26 proximate an upper end 34 thereof, the sealing material 32 encircling the contact tail and extending over a short length of the contact tail so as to be spaced from a midsection 36 of the contact tail received against the printed circuit board hole 30, in order to avoid the sealing material contaminating the soldering zone of the contact tail.

The sealing material 32 can either be a gel-like substance that could be hardenable, for example by thermal means. Depending on the applications, one could also use a gel that is not hardened. The sealing material 32 has flow properties such that when compressed the sealing material easily adapts to the surrounding volume similarly to commonly used sealing gels.

The terminal 6 is assembled to the connector housing 4 by inserting the contact tail 26 through the contact tail receiving cavity section 16 until the sealing material 32 on the contact tail 26 is urged into the contact tail receiving cavity section 16. The outer periphery of the sealing material deposited on the contact tail 26, is greater than the periphery of the contact tail receiving cavity section 16 such that the sealing material 32 is squeezed into the funnel section 14 of the cavity, thereby completely sealing between the contact tail 26 and the contact tail receiving cavity section 16. The connector mounting face 12 is thereby sealed off from the environment and additionally prevents solder and flux from wicking up the contact tail 26 into the housing 4 during soldering thereof to the printed circuit board 20.

The concept as described hereinabove, is advantageous in many aspects. Firstly, due to the application of the sealing material on the contact tail 26, the cavity section 16 extending to the mounting face 12 of the connector housing 4 can be of very small periphery, whereby the cavity section 16 may be profiled substantially against the contact tail 26 as no sealing material must be applied from the mounting face 12, but rather is urged into the funnel-shaped section 14 that is within the connector housing. The latter means that very small optimal quantities of sealing material 32 can be used, and the sealing surfaces are very small thereby also increasing the reliability of the sealing. A further advantage is the urging of the sealing material 32 into the cavity section 16 which is then forced to flow into the funnel-shaped section 14 of the cavity 8, allowing the use of a gel which is not very liquid, eliminating the risk of the sealing material flowing onto the contact section 22. The concept also has the advantage that the contact tail 26 does not get contaminated by the sealing material 32 during assembly of the terminal into the housing.

We claim:

1. An electrical connector comprising an insulative housing with terminal receiving cavities extending therethrough from a mounting face to a terminal receiving face, and electrical terminals having contact tails, the terminals mountable in the terminal receiving cavities of the housing such that the contact tails project below the mounting face, wherein the contact tails have sealing material deposited thereon prior to mounting in the terminal receiving cavities and wherein the terminal receiving cavities comprise contact tail receiving cavity sections proximate the mounting face, the contact tail receiving cavity sections having a smaller periphery than the sealing material such that the sealing material is squeezed between the contact tails and contact tail receiving cavity sections for hermetic sealing therebetween when the terminals are mounted in the housing.

2. The connector of claim 1 characterized in that the contact tails are for soldered connection to a printed circuit board.

3. The connector of claim 1 characterized in that the sealing material is a gel.

4. The connector of any preceding claim characterized in that the sealing material is deposited such that it encircles the contact tails.

5. The connector of claim 4 characterized in that the terminal receiving cavities have funnel-shaped sections proximate the PCB mounting face, the funnel shape converging in the direction from the connector towards the PCB, the funnel-shaped sections extending into contact tail receiving cavity sections closely surrounding the contact tails when mounted thereto.

6. The connector of claim 5 characterized in that part of the sealing material flows into the funnel shaped sections during insertion of the contact tails through the contact tail receiving cavity sections.

* * * * *